United States Patent [19]

Shepherd

[11] 3,996,854

[45] Dec. 14, 1976

[54] DUPLICATING APPARATUS

[75] Inventor: George E. Shepherd, Dollard-des-Ormeaux, Canada

[73] Assignee: Procedures, Systemes et Methodes P.S.M. (1972) Inc., Quebec, Canada

[22] Filed: July 1, 1975

[21] Appl. No.: 592,353

Related U.S. Application Data

[63] Continuation of Ser. No. 422,370, Dec. 6, 1973, abandoned.

[52] U.S. Cl. ..... 101/132.5; 101/53

[51] Int. Cl.[2] ..... B41L 11/08

[58] Field of Search ..... 101/53, 132, 132.5

[56] References Cited

UNITED STATES PATENTS

| | | | |
|---|---|---|---|
| 2,271,954 | 2/1942 | Rockhill | 101/132.5 |
| 2,465,160 | 3/1949 | Levenhagen et al. | 101/132.5 |
| 2,586,461 | 2/1952 | Ford et al. | 101/132.5 |
| 2,615,391 | 10/1952 | Ford | 101/132.5 |
| 3,016,821 | 1/1962 | Ritzerfeld et al. | 101/132.5 |
| 3,245,342 | 4/1966 | Wright | 101/53 |
| 3,444,807 | 5/1969 | Kooch | 101/53 |
| 3,640,215 | 2/1972 | Shepherd | 101/53 |
| 3,714,893 | 2/1973 | Cole | 101/228 |
| 3,807,303 | 4/1974 | Petersen | 101/132.5 |

*Primary Examiner*—Edgar S. Burr
*Assistant Examiner*—William Pieprz
*Attorney, Agent, or Firm*—Larson, Taylor and Hinds

[57] ABSTRACT

Duplicating apparatus for reproducing printed matter from a master card onto labels. The appartus is of very simple construction and enables adjustment of the position of the printed area on the labels.

10 Claims, 3 Drawing Figures

DUPLICATING APPARATUS

This is a continuation, of application Ser. No. 422,370 filed Dec. 6, 1973 and now abandoned.

This invention relates to duplicating apparatus for transferring information from a master card onto labels or the like by the known hectographic process.

Duplicating apparatus are well known and have been used widely for transferring information from a relatively small card made of a cardboard onto copy wherein a trace of carbon on the back of the master card is left on an area of the copy onto which solvent had just previously been applied. Such duplicating apparatus are used principally as addressing machines wherein the master cards are fed one by one in synchronization with the feeding of the envelopes thereby to obtain one addressed envelope for every card.

The hectographic process however does not appear to have been used for making multiple duplications of the same card. Yet, the use of cardboard master cards as opposed to rigid cards made of plates of metal or plastic is known to be quite advantageous in many respects. In fact, the information on hectographic cards can be filled in by using a standard typewriter whereas rigid cards require the use of a special embossing machine which is comparatively expensive and therefore not always readily available. Therefore it is the practice to have rigid cards embossed by an outside concern, with consequential delays and loss of confidentiality. Hectographic cards are also much cheaper and can be destroyed very simply.

The main object of the invention is therefore to permit the use of the hectographic system of duplication for preparing series of labels or the like bearing the same information.

Such labels are used for example in shipping departments of stores and warehouses where the attending personnel upon receipt of an order will gather the requested material or supply, prepare a packing slip and place the material into a suitable number of containers normally cardboard boxes. The next operation involves preparing a number of identical labels to be affixed to the individual cardboard boxes for directing the shipping of the goods to a predetermined address.

Another object of the invention is to provide a duplicating machine which is much simpler than current hectographic duplicators and which is particularly designed to carry out any desired number of duplications of a given master card.

A further object of the invention is to provide a label printing machine which is very simple to operate and which requires practically no maintenance.

In accordance with this invention, the above noted objects can be obtained by means of the combination of a relatively large drum adapted to retain thereon a master card and a printing roll frictionally engaged by the drum and located essentially below the drum. The combination also includes a driven feed roll rotatably mounted forwardly of the printing roll, one or more nip rolls riding over the feed roll and a moistening roll intermitently urged towards the feed roll for moistening a predetermined area on one face of a label prior to reaching the contact area between the card carrying drum and the printing roll.

This invention therefore provides a duplicating apparatus which comprises a frame, a drum supported to said frame by means of a main shaft, actuating means for rotating the main shaft, a printing roll made of rubber-like material vertically spaced from the main shaft and positioned essentially below the drum for constant frictional engagement therewith, a feed roll located forwardly of the printing roll and drive means causing rotation of the feed rolls in the same sense and at the same linear speed than the printing roll. A pivotable shaft mounted to the frame slightly above and behind the feed roll carries a moistening roll supporting yoke and an arrangement consisting of a cam on the main shaft and a cam lever carried by the pivotable shaft causes engagement of the moistening roll with the feed roll during a predetermined angular displacement of the main shaft once every successive revolution thereof. Stop means is provided for controlling the angular position of the main shaft at the beginning of every printing operation and means is provided for adjusting this starting angular position.

In a particular embodiment, a crank handle is provided for manually rotating the main shaft upon feeding the labels one by one and a synchronizing pin extending through the cam on the main shaft and a stop-start disc which cooperates with the above noted stop means permits adjustment of the initial angular position of the main shaft due to the presence of a series of possible positions of the cam relative to the disc. Preferably the stop means will prevent accidental rotation of the drum in the wrong direction from the starting position.

For retaining a master card onto the drum as noted above, spaced apart spring leaves may be provided with a free end defining a lip portion which is constantly urged towards the surface of the drum sufficiently to frictionally retain the leading edge of the card.

It is also preferred that the main shaft and the pivotable shaft be mounted in a cantilevered arrangement to one of two spaced apart vertical walls of the frame so as to provide free access to the path of the labels.

In a particular embodiment, the invention provides an adjustment for varying the pressure between the drum and the printing roll.

A preferred embodiment of the invention is illustrated in the accompanying drawings wherein, FIG. 1 is a side elevation of a duplicating apparatus with a central portion of a vertical wall broken away;

Figure 1:
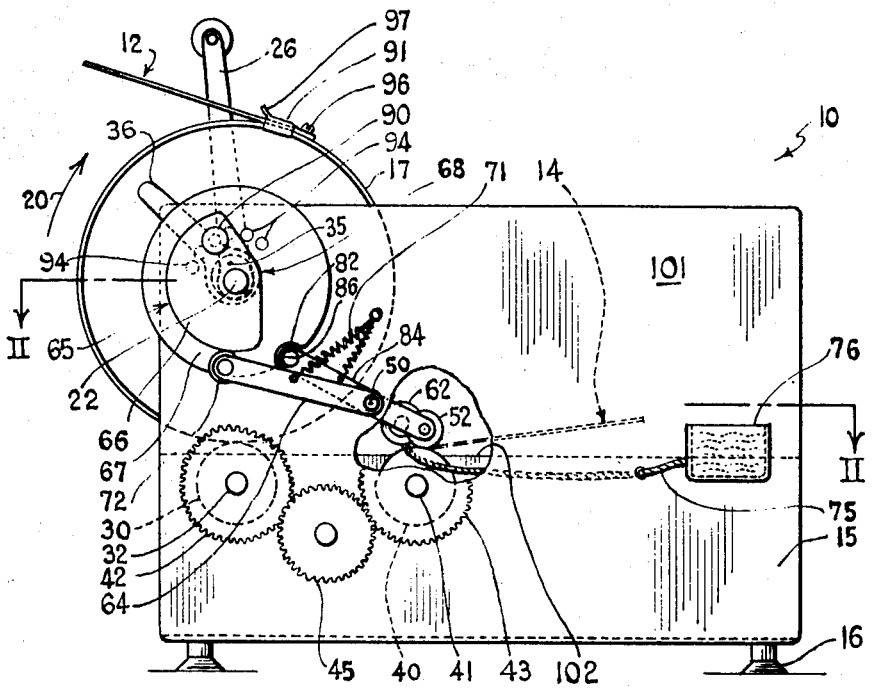
Figure 2:
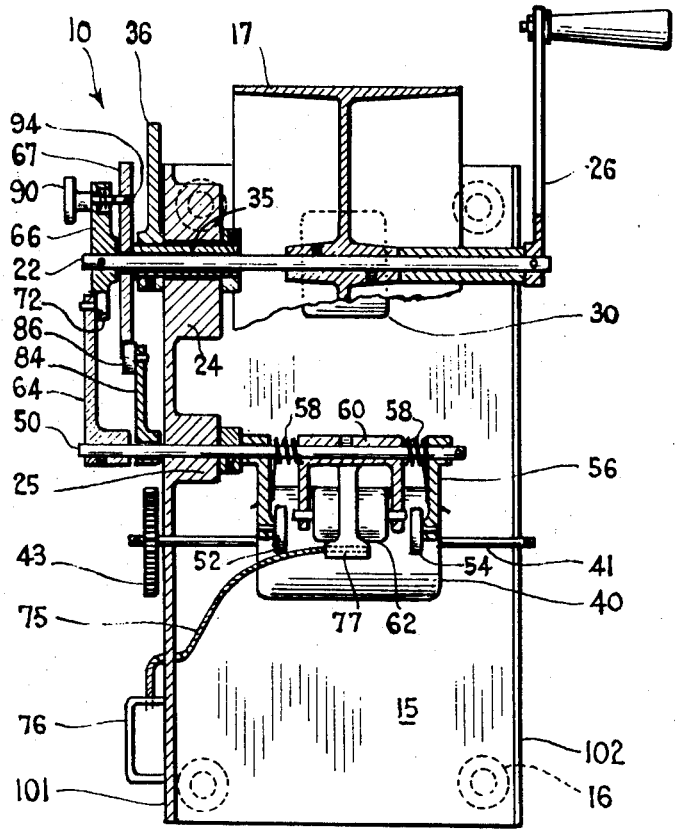
FIG. 2 is a cross-sectional view in slightly larger scale taken along line II—II of FIG. 1.
Figure 3:
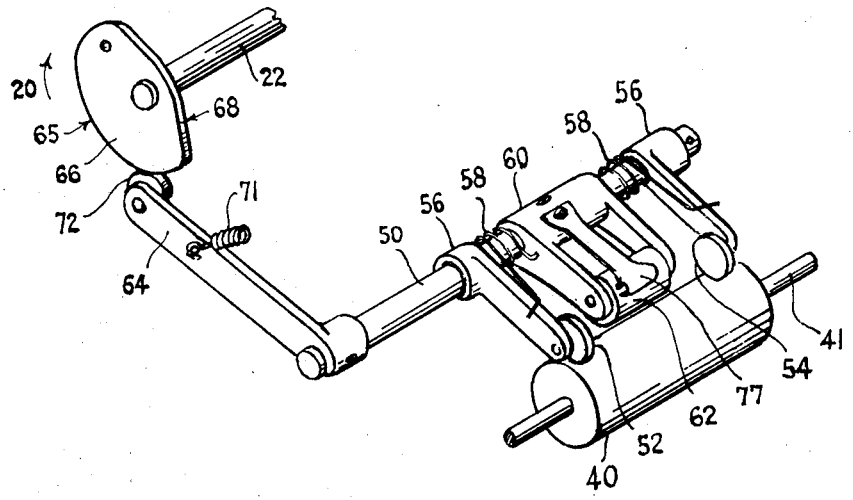
FIG. 3 is a perspective view of the pivotable shaft and moistening roll assembly as used in the duplicating apparatus of FIGS. 1 and 2.

Referring now to FIGS. 1, 2 and 3, the illustrated examplary embodiment will now be described in detail using the reference numerals in the drawings.

The duplicating apparatus 10 is designed for transferring printed information from a master card 12 to a receiving copy 14 by means of the hectographic process. The apparatus combines a frame 15 on four suction cup legs 16, a drum 17 designed to carry a master card 12 and rotatable in a predetermined sense as shown by arrow 20 for effecting one duplication for each revolution of drum 17 provided of course a receiving copy 14 is being fed at the beginning of every successive revolution. A main shaft 22 extending horizontally is journaled to frame 15 by means of a bearing assembly 24. Drum 17 is of relatively large diameter and is fixedly supported to the intermediate portion of main shaft 22 for rotation therewith. Actuating means 26 in the form of a crank is connected to the main shaft 22 for the purpose of rotating same manually.

A printing roll 30 made of rubber or other similar material is rotatably mounted to frame 15 by means of a printing roll shaft 32 which can be seen in FIG. 1. Printing roll shaft 32 is essentially parallel and vertically spaced below the main shaft 22 so as to permit contact between the periphery of printing roll 30 and drum 17. The pressure between drum 17 and printing roll 30 should preferably be adjustable. To this effect, an excentric bushing 35 supports main shaft 22, and an actuating lever 36 permits rotation of bushing 35 relative to frame 15 as shown in FIGS. 1 and 2. Bushing 35 is closely fitting within an aperture extending through frame 15 with sufficient friction to ensure a constant pressure setting. Main shaft 22 however is freely rotatable within the off-center bore through bushing 35. Printing roll 30 should be maintained in sufficient frictional engagement with the periphery of drum 17 to ensure rotation of printing roll 30 with drum 17 with practically no slipping.

A feed roll 40 also made of rubber or the like material is rotatably mounted to frame 15 on a feed roll shaft 41 which is essentially parallel to and spaced forwardly of the printing roll shaft 32. Drive means 42, 43, 45 interconnects feed roll 40 to printing roll 30 and causes rotation of feed roll 40 upon turning of printing roll 30 due to its frictional engagement with drum 17. It will be seen that for proper feeding of the labels to be printed the peripheries of rolls 30 and 40 must turn in the same sense and at the same linear speed. In the illustrated embodiment, rolls 30 and 40 being of equal diameter, drive means consists of two identical gears 42 and 43 secured to printing roll shaft 32 and feed roll shaft 41 in meshing engagement with an idler 45. Gears 42 and 45 have been omitted in FIG. 2.

A pivotable shaft 50 is mounted to frame 15 slightly above and behind feed roll shaft 41 and parallel thereto. The primary function of pivotable shaft 50 is to support a moistening roll yoke 60 which in turn carries a freely rotatable moistening roll 62. Moistening roll 62 extends parallel to and generally above feed roll shaft 41. Pivotable shaft 50 is fixedly connected at one end to a cam lever 64 which projects rearwardly toward main shaft 22. Main shaft 22 carries a rotary cam 66 which has a lobe portion 65 and a depressed portion 68. Return spring 71 urges lever 64 and cam follower 72 toward cam 66. Hence, rotation of main shaft 22 under the action of handle 26 causes pivoting of pivotable shaft 50 in relation to the shape of cam 66, with the result that when cam follower 72 runs past lobe 65 into depressed portion 68, moistening roll 62 moves toward feed roll 40. Moistening roll 62 returns to its spaced-apart position when cam follower 72 again reaches lobe portion 65 on cam 66. A suitable wick 75 (not shown in FIG. 3) leading from a solvent container 76 to moistening roll 62 applies solvent to the periphery of moistening roll 62. A suitable clip 77 holds the end of wick 75 in place on moistening roll 62.

Pivotable shaft 50 is also used to support two nip roll levers 56 although other means of support could be used. Each lever 56 is free to turn on shaft 50 and carries at the other end of a freely rotatable nip roll 52, 54 riding on a marginal edge of feed roll 40. Coil springs 58 apply a substantial downward bias to levers 56 and thus keep nip rolls 52, 54 in contact with feed roll.

The illustrated duplicating apparatus also incorporates stop means for controlling the angular position of drum 17 and of main shaft 22 at the beginning of every successive revolution thereof. A disc-like member 67 is mounted freely to main shaft 22 but is designed to normally rotate therewith due to its connection with cam 66 by means of pin 90. Disc-like member 67 comprises a peripheral depression or notch 82. A spring biased lever 84 carrying a small roller 86 at one end is mounted at its other end to pivotable shaft 50 which constitutes a convenient means of support. Lever 84 is free on shaft 50 and return spring 88 applies the necessary bias toward the periphery of disc-like member 67. Hence, when roller 86 falls into notch 82, a sudden resistance to rotation of drum 17 is felt, indicating the end of a printing cycle. The length of lever 84 is such that when roller 86 rests into notch 82, the prolongation of the axis of lever 84 extends below main shaft 22. This configuration prevents accidental rotation of drum 17 in the sense opposite to arrow 20 but allows rotation of the drum assembly from the start position in the direction of arrow 20.

The operation of the machine thus far described is as follows. With a cardboard master card 12 supported to drum 17 by means of clips 91, and while drum 17 is in its starting position as shown in FIG. 1, a label 14 is held with one edge against nip rollers 52 and 54. The operator then initiates the printing cycle by rotating drum 17 by means of handle 26 in the sense indicated by arrow 20. Rotation of drum 17 causes rotation of printing roll 30 and feed roll 40. Rotation of feed roll 40 causes engagement of label 14 between feed roll 40 and nip rollers 52, 54. The operator can now release label 14 which continues feeding as long as drum 17 rotates.

Once drum 17 has rotated roughly 1/6 of a revolution, cam follower 72 reaches the depressed portion 68 of cam 66, and thus spring 71 rotates pivotable shaft 50 to lower moistening roll 62 onto label 14. This leaves on label 14 a trace of solvent as wide as the length of moistening roll 62, but the length of the trace is determined by the angular extent of the depressed portion 68 on cam 66. The moistening roll 62 should return to its retracted position before the trailing edge of label 14 reaches nip rollers 52, 54 so that feed roll 40 remains free of solvent.

Once drum 17 has been rotated about one half the revolution, the leading edge of label 14 reaches the contact area of printing roll 30 with drum 17. At that point, master card 12 has also reached this contact area with the result that label 14 lays over master card 12 with its wetted area directly over the printed matter on the master card. Both card and label feed at the same speed through the area of contact of printing roll 30 and drum 17. The pressure exerted by printing roll 30 will cause transfer of information from the master card 12 to label 14. Beyond printing roll 30, the printed label is free to separate from master card 12 which however remains attached to drum 17. Rotation of drum 17 by means of handle 26 stops when stop roller 86 reaches notch 82 on disc-like member 67. This ends a complete printing cycle. The machine however is ready for repeating duplication of the same master card. All the operator does is place another blank label as at 14 and rotate handle 26 for one complete revolution of drum 17.

A significant feature of the present duplicating machine is that by varying the angular position of disc-like member 67 relative to cam 66, one effectively changes the position of the printed area along label 14. In fact, the starting position of disc-like member 67 relative to frame 15 is always the same, so that changing the position of main shaft 22 relative to disc-like member 67, will necessarily change the circumferential distance that separates master card 12 from printing roll 30 at the starting position. However, this variation does not affect the distance which label 14 must move before reaching printing roll 30 from the starting position.

In order to permit adjustment of the angular position of main shaft 22 relative to disc-like member 67, a series of axial apertures 94 are bored through disc-like member 67 at the same distance from the center so that synchronizing pin 90 can be received in any one of such apertures 94. Pin 90 which extends through cam 66 is preferably spring loaded toward apertures 94 as shown in FIG. 2.

Referring again to the mounting of master card 12 on drum 17, two spaced-apart spring leaves or clips 91 can be used, one only being shown in FIG. 1. Each clip 91 is secured to drum 17 as at 96 by any suitable means e.g. a small metal screw. The free end of clip 91, however, extends in the trailing direction and forms a suitable lip portion 97 which bears against the surface of drum 17 and terminates with an outwardly curved tail. This arrangement permits the master card 12 to be held in position by its leading edge only.

Preferably, printing roll 30 will be made sufficiently short so as to ride along the middle portion of the drum's surface and avoid the two spaced apart clips 91.

In a slightly different arrangement which however is not illustrated, the side edges of the master card are retained over the marginal edges of drum 17 by means of peripheral flanges that define two facing grooves.

It will be noted that main shaft 22 and pivotable shaft 50 are mounted to the same vertical wall 101 of frame 15 by means of bearing assemblies 24 and 25 in cantilevered arrangements. This construction permits an open face design with wall 101 defining the back wall of the machine. The front face of the machine comprises a low wall 102, an upper region which incorporates the moistening roll assembly and drum 17, and a space therebetween which defines a slot for the labels. The machine therefore can receive wide labels. Hence, the machine can be relatively narrow and still print wide labels. Printing roll shaft 32 and feed roll shaft 41 however can extend across and be supported by both vertical walls 101 and 102 of frame 15.

I have also discovered that the use of spring biased nip rollers 52, 54 which constantly bear against feed roll 40 greatly simplify the construction of manual duplicating apparatus. The role of this arrangement is twofold; while handle 26 is at the starting position the operator feeds blank 14 with its leading edge wedging between the nip rollers 52, 54 and the feed roll 40. This properly locates the blank relative to master card 12, and sets blank 14 in proper alignment. Upon actuation of handle 26, rotation of feed roll 40 advances blank 14 with practically no slipping provided bias springs 58 be sufficiently strong. In prior master card duplicators this double function was carried out by a set of retractable stop fingers and dripping nip rollers which give good results but require quite a few additional components. A particular example is disclosed in Canadian Pat. 892,140 dated Feb. 1, 1972 to which corresponds U.S. Pat. 3,640,215 issued Feb. 8, 1972. The type of addressing machine therein disclosed can be improved in accordance with this invention by substituting a pair of spring biased nip rollers for the retractable stop fingers, the dropping nip rollers and the associated control means.

The embodiments of the invention in which an exclusive property or privilege is claimed are defined as follows:

1. Duplicating apparatus including means for transferring printed information from a master card to a receiving copy by means of the hectographic process comprising the combination of a frame, a master card carrying drum rotatable in a predetermined sense for effecting one duplication per revolution of said drum when a receiving copy is present, a main shaft extending horizontally and being journalled to said frame, said drum being of relatively large diameter and being fixedly supported to the intermediate portion of said main shaft for rotation therewith, actuating means connected to said main shaft for rotating same, whereby any number of copies can be made from a master on the drum by simply turning the drum with the master attached thereto the desired number of times while feeding separate receiving copies thereto, a pressure roll made of rubber-like material rotatably mounted to said frame on a pressure roll shaft parallel to said main shaft and vertically spaced therebelow, means for maintaining the periphery of said pressure roll in constant frictional engagement with the periphery of said drum, a feed roll made of rubber-like material rotatably mounted to said frame on a feed roll shaft located essentially forwardly of said pressure roll shaft and extending parallel thereto, drive means for interconnecting said feed roll and said pressure roll and for causing rotation of said feed roll upon rotation of said pressure roll in the same sense and at the same linear speed, a pivotable shaft mounted to said frame parallel to said main shaft and extending slightly above and slightly behind said feed roll shaft, a moistening roll yoke secured to said pivotable shaft for angular displacement therewith, a moistening roll rotatably mounted to said yoke around an axis parallel to said pivotable shaft, said moistening roll being substantially shorter than said feed roll, a pair of forwardly extending spring located nip roll levers pivotably mounted on said pivotable shaft and rotatable relative thereto, each said nip roll lever carrying a freely rotatable nip roll resiliently urged into constant engagement with said feed roll, the nip rolls and the feed roll forming a means for initially receiving the receiving copy into the apparatus and for cooperating with each other to feed the copy directly to the drum and pressure roll, a cam lever connected to said pivotable shaft and projecting rearwardly toward said main shaft, return spring means for urging said cam lever toward said main shaft, cam means secured to said main shaft for pivoting said cam lever, pivotable shaft, and yoke to raise and lower said moistening roll toward and away from said feed roll, whereby the turning movements of the main shaft are translated directly into intermittent movements of the moistening roll into and out of engagement with the feed roll to thus permit contact therewith over a substantial angular displacement of said cam means, wick means for wetting said moistening roll with solvent, stop means for controlling the starting angular position of said main shaft at the beginning of every successive revolution of said drum, and adjustment means for said stop means for varying said starting angular position to vary the angular position of the master on the drum, relative to the leading edge of the sheet, to vary the location of the master relative to the leading edge of the receiving copy.

2. In a duplicating apparatus, the combination of a frame, a main shaft rotatably mounted to said frame, a master card carrying drum secured to said main shaft for effecting one duplication per revolution of the drum, actuating lever means fixed to a first end of said main shaft for rotating same, whereby any number of copies can be made from a master on the drum by simply turning the drum with the master attached thereto the desired number of times while feeding separate receiving copies thereto, a cam fixed to said main shaft near the opposite end thereof, stop means for determining a starting angular position of said main shaft, control means for varying said starting position of said main shaft relative to said frame to vary the angular position of the master on the drum, relative to the leading edge of the sheet, to vary the location of the master relative to the leading edge of the receiving copy, a pressure roll rotatably supported to said frame generally below said drum but in frictional engagement therewith, a pivotable shaft, a cam lever secured to said pivotable shaft, a cam follower co-acting with said cam and carried by said cam lever, a yoke fixed to said pivotable shaft, moistening means carried by said yoke, a feed roll rotatably supported to said frame immediately below said moistening means, whereby the turning movements of the main shaft and drum are translated directly into intermittent movement of the moistening means into and out of engagement with the feed roll, spring biased nip roll means pivotably mounted on said pivotable shaft and rotatable relative thereto, said nip roll means carrying a freely rotatable nip roll for constantly bearing against the upper region of said feed roll adjacent the moistening means, said nip roll means, nip roll and said feed roll, forming a means for initially receiving the receiving copy into the apparatus and for cooperating with each other for feeding the copy directly to the drum and pressure roll, and drive means for interconnecting said feed roll and said pressure roll for rotation at the same linear speed and in the same sense.

3. In a manual duplicating apparatus of the type using master cards for transferring information onto copy by the known hectographic process, wherein each copy is supplied by hand to a copy receiving region prior to actuation of the copy translating mechanism, the improvement wherein said copy receiving region comprises a driven feed roll and at least two spaced-apart nip rollers constantly resiliently urged into engagement with the periphery of said feed roll, each of said nip rollers being freely rotatably mounted on arms freely rotatably mounted on a pivotable shaft, the axis of which is parallel to the axis of rotation of said feed roll, a moistening means fixed to said pivotable shaft and movable therewith upon pivoting of said pivotable shaft and means for intermittently pivoting said pivotable shaft for intermittently moving said moistening means into and out of contact with said copy as the copy passes between said feed roll and said nip rollers, said nip rollers being located at either end of the moistening means and including means for constantly resiliently urging the nip rollers against the periphery of said feed roll along the marginal edges thereof.

4. Apparatus as defined in claim 2 wherein said actuating lever means comprises an actuating lever to be manually rotated, and wherein said stop means comprises a disc-like member freely mounted to said main shaft adjacent said cam, synchronizing pin means extending axially through said cam and through said disc-like member for connecting said disc-like member to said cam, said stop means further comprising a depression on said disc-like member and spring loaded detent means engageable into said depression for marking the end of each revolution of said main shaft.

5. Apparatus as defined in claim 4 wherein said detent means and said depression cooperate to form a lock against rotation of said main shaft in the wrong sense from its starting position.

6. Apparatus as defined in claim 4 wherein said control means comprises a plurality of apertures through either one of said cam means and disc-like member, said apertures being spaced-apart in an arc of a circle centered upon the axis of rotation of said main shaft and each aperture being positioned and dimensioned so as to receive said synchronizing pin means for connection of said cam means and disc-like member.

7. Apparatus as defined in claim 2 wherein said drum comprises a pair of spaced-apart spring leaves, being axially aligned, having one end secured to the periphery of said drum near one edge thereof, and extending in the trailing sense relative to the normal sense of rotation of said drum, the free ends of said spring leaves defining lip portions urged toward the surface of said drum and frictionally retaining the leading edge only of said master card which extends tangentially of said drum in said trailing sense, said pressure roll being just sufficiently narrow to roll on the periphery of said drum in the space between said spring leaves during rotation of said drum in said predetermined sense.

8. Apparatus as defined in claim 2 wherein said pressure roll and said feed roll are of equal diameter and wherein said drive means comprises a printing roll gear fixed to said pressure roll shaft, an auxiliary gear in meshing engagement with said pressure roll gear, and a feed roll gear fixed to said feed roll shaft in meshing engagement with said auxiliary gear, the number of teeth on said pressure roll gear being equal to the number of teeth on said feed roll gear.

9. Apparatus as defined in claim 2 comprising bearing means for rotatably mounting said main shaft and said pivotable shaft to said frame, said bearing means being on a first vertically extending wall member of said frame, said pressure roll shaft and said feed roll shaft extending in cantilevered arrangement across the space between said first wall and a second wall parallel to said first wall and spaced-apart therefrom, said second wall terminating below said pivotable shaft and said main shaft for giving free access to the path of said receiving copy.

10. Apparatus as defined in claim 2 wherein said main shaft is supported to said frame by means of an eccentric bushing closely fitting within an aperture extending through said frame, and having a longitudinal eccentric bore through which said main shaft extends, said main shaft being freely rotatable within said bore, said eccentric bushing comprising an actuating lever for permitting manual adjustment of the angular position of said bushing relative to said frame.

* * * * *